US006640465B1

(12) United States Patent
Burgess

(10) Patent No.: US 6,640,465 B1
(45) Date of Patent: Nov. 4, 2003

(54) DISPOSABLE FOOT PROTECTOR

(76) Inventor: Marjorie S. Burgess, 3307 Leritz La., Edgewater, MD (US) 21037

( * ) Notice: Subject to any disclaimer, the term of this patent is extended or adjusted under 35 U.S.C. 154(b) by 229 days.

(21) Appl. No.: 09/372,149

(22) Filed: Aug. 11, 1999

(51) Int. Cl.[7] ..... A43C 13/00; A43B 21/36

(52) U.S. Cl. ..... 36/15; 36/42; 36/25 R; 36/30 R; 36/73

(58) Field of Search ..... 36/11.5, 15, 22 R, 36/30 R, 32 R, 25 R, 73, 100, 7.5, 9 R, 96, 102, 103, 104, 106, 71, 43, 44, 8.1; 602/66

(56) References Cited

U.S. PATENT DOCUMENTS

| | | | | |
|---|---|---|---|---|
| 2,205,091 A | | 6/1940 | Geffner | |
| 2,677,906 A | * | 5/1954 | Reed | 36/44 |
| 2,747,301 A | | 5/1956 | Crane | |
| 2,985,970 A | | 5/1961 | McCarthy | |
| 3,148,378 A | | 9/1964 | Tibbits | |
| 3,693,269 A | * | 9/1972 | Guarrera | 36/30 R |
| 3,733,721 A | | 5/1973 | Clemens | |
| 3,903,620 A | | 9/1975 | Gillet | |
| 4,644,669 A | * | 2/1987 | Greco | 36/9 R |
| 4,751,784 A | | 6/1988 | Petker et al. | |
| 4,801,494 A | | 1/1989 | Datta et al. | |
| 4,926,568 A | | 5/1990 | Coffman | |
| 5,394,624 A | | 3/1995 | Siepser | |
| 5,433,695 A | * | 7/1995 | Drennan | 36/15 |
| 5,735,805 A | | 4/1998 | Wasserman et al. | |
| 5,771,605 A | * | 6/1998 | Safdie | 36/25 R |
| 5,799,415 A | * | 9/1998 | Kenji et al. | 36/44 |
| 5,983,527 A | * | 11/1999 | Strickland et al. | 36/22 R |

FOREIGN PATENT DOCUMENTS

| | | | | |
|---|---|---|---|---|
| FR | 410461 | * | 8/1932 | 36/32 R |
| GB | 922297 | * | 3/1927 | 36/11.5 |

OTHER PUBLICATIONS

Product sample relating to U.S. Patent 4,801,494.

* cited by examiner

*Primary Examiner*—Anthony D. Stashick
(74) *Attorney, Agent, or Firm*—Oliff & Berridge, PLC

(57) ABSTRACT

A foot protector includes a resilient sheet member having a shape generally matching a shape of a sole of a foot and having a size generally corresponding to a size of the foot. The resilient sheet member has a foot-contact surface, and a tack adhesive layer is provided on at least a portion of the foot-contact surface. The foot protector is lightweight and readily removable and disposable. The foot protector readily conforms to the three-dimensional contours of the sole of the feet, allowing increased mobility of the foot and increased adhesion as a greater effective contact surface area is provided. The foot protector is also preferably of a substantially constant thickness to reduce manufacturing costs.

13 Claims, 4 Drawing Sheets

DISPOSABLE FOOT PROTECTOR

BACKGROUND OF THE INVENTION

1. Field of Invention

This invention relates to a disposable foot protector.

2. Description of Related Art

There are many situations in which a person is faced with the prospect of walking barefoot across surfaces of indeterminate cleanliness and temperature fluctuations. For example, a person entering or exiting a spa, a health club, medical facility, going to or from or in a shower at a gym or the like, may need to walk barefoot across a surface that is unsanitary, cold, wet, hot, slippery or otherwise undesirable to a person. As another example, a person entering a private home of another may be required to remove their daily wear shoes, but one or both parties does not want the person to walk barefoot in the home.

SUMMARY OF THE INVENTION

It would be advantageous to have a foot protector that protects the foot from contact with such surfaces, and which is lightweight, flexible, inexpensive and readily disposable.

Accordingly, in one aspect, the invention provides a foot protector, including a resilient sheet member of substantially uniform thickness, and having a shape generally matching a shape of a sole of a foot and generally corresponding in size to the foot. The resilient sheet member includes a foot-contact surface, and a tack adhesive layer is provided on all or at least a portion of the foot-contact surface. A peel-off layer may be detachably provided on the tack adhesive layer to cover and protect the tack adhesive layer. The resilient sheet member is also preferably formed to be lightweight, flexible and have a small thickness.

According to another aspect, the invention provides a foot protector, including a resilient sheet member, that easily conforms to the contour of a sole of a wearer's foot, with the resilient sheet member having a shape generally matching a shape of the sole of the foot and generally corresponding in size to the wearer's foot. The resilient sheet member includes a foot-contact surface. Again, a tack adhesive layer is provided on all or at least a portion of the foot-contact surface to adhere the foot protector to the wearer's foot. A the resilient sheet member is thin and flexible, the foot protector is able to readily conform to the shape and contour of the wearer's foot. This is advantageous as it provides a greater effective surface to which the tack adhesive can stick. Thus, there is less likelihood that the foot protector will fall off. Moreover, it accommodates many varying foot details, such as feet with high arches, flat feet, and the like and can provide additional mobility of the foot as it can readily conform to the three-dimensional curvature of a foot.

The resilient sheet member can be made of various inexpensive materials. Therefore, the foot protector can be manufactured and sold at low cost. Furthermore, the foot protector is extremely compact and lightweight, and can easily be carried in a purse, handbag or the like or stored in a dispenser.

These and other objects and advantages of this invention are described in or are apparent from the following description of various exemplary embodiments.

BRIEF DESCRIPTION OF THE DRAWINGS

Various exemplary embodiments of the invention will be described in detail below in conjunction with the drawings, in which.

DETAILED DESCRIPTION OF EXEMPLARY EMBODIMENTS

This invention provides an inexpensive foot protector that can be readily affixed to a wearer's foot to protect the sole of the foot from conditions on a walking surface, such as slipping, cold, heat, roughness, hardness, wetness and the like, as well as providing additional overall comfort to the wearer. The invention also provides a foot protector that is inexpensive, flexible, readily removable and disposable.

Figure 1:
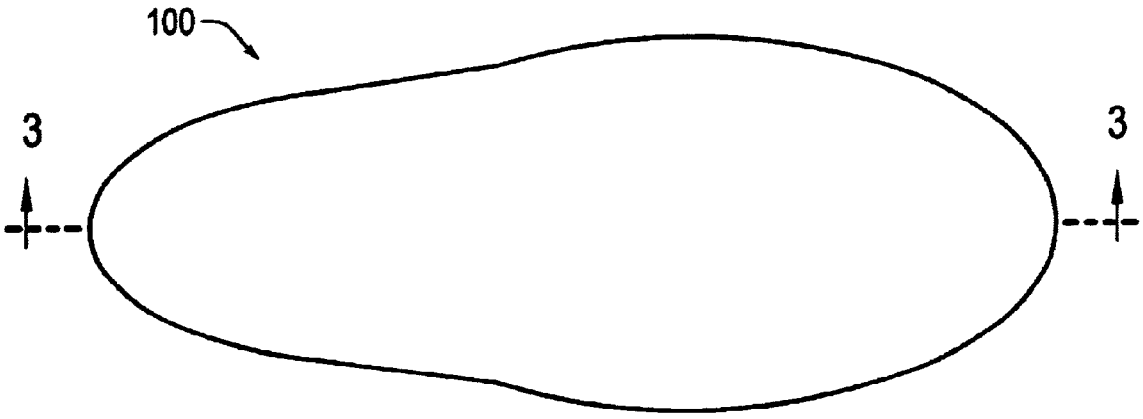
FIG. 1 shows a top view of a foot protector according to an embodiment of this invention.
Figure 2:
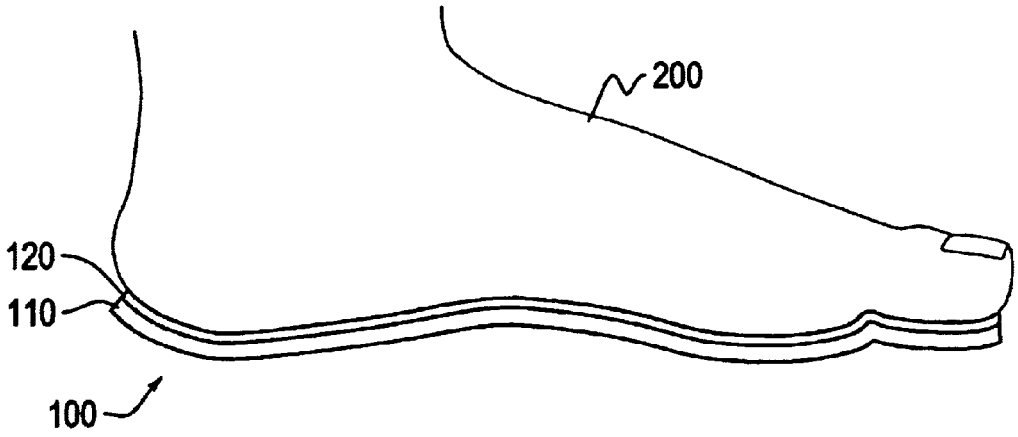
FIG. 2 shows a side view of the foot protector of FIG. 1, attached to a foot and closely matching the contour of the sole of the foot.
Figure 9:
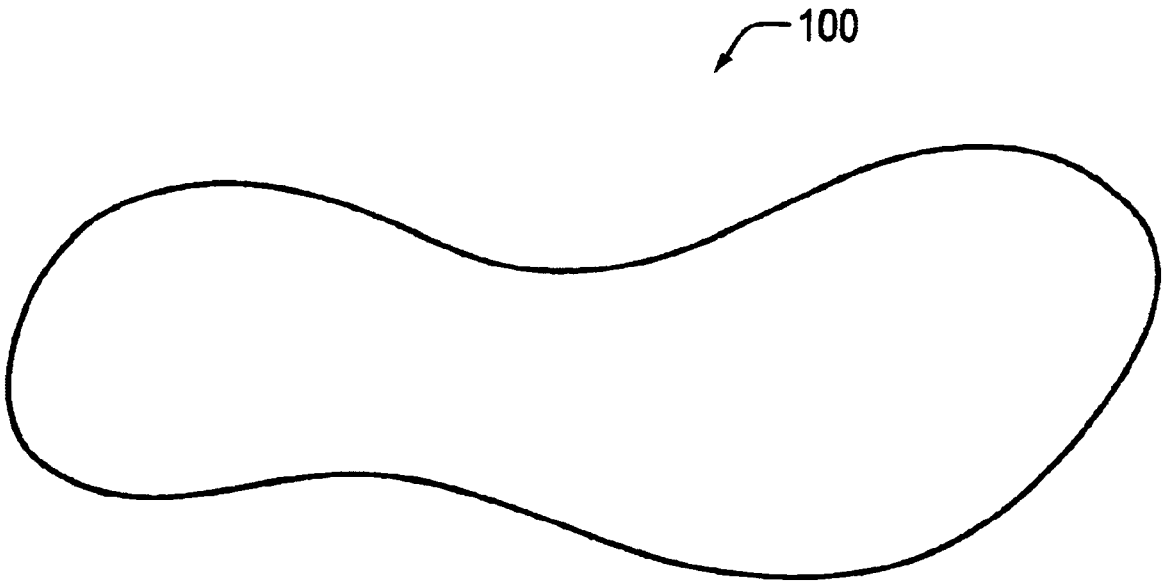
FIG. 9 shows a top view of an alternative foot protector formed to closely match the shape of a right foot.

FIG. 1 shows a top view of a foot protector 100 according to one exemplary embodiment this invention. The foot protector 100 has a shape generally matching a shape of a sole of a foot, and has a size generally corresponding to a size of the foot. For example, as shown in FIG. 2, a foot 200 almost fits within the boundaries of the foot protector 100. However, the foot protector 100 could be slightly larger than or slightly smaller than the foot. The foot protector 100 of FIG. 1 has a shape that may be interchangeably used with either a left foot or a right foot. However, it may also be desirable to provide separate left and right foot protectors specially shaped to correspond to a left foot shape and a right foot shape, respectively, such as the right foot protector shown in FIG. 9. A left foot protector would have a similar, but reversed shape. The left and right foot protectors 100 would be packaged as a pair or a number of pairs. Moreover, while the foot protector can be formed and packaged in a large number of various sizes, the foot protector can also be formed into one or more larger sizes and subsequently cut to fit by the wearer. However, for ease of use and disposability, it is preferable to have the foot protector formed to generally correspond to the size of the foot.

FIG. 2 shows a side view of the foot 200 standing on the foot protector 100. The foot protector 100 has a resilient sheet member 110 of substantially uniform thickness, and a tack adhesive layer 120 provided on at least a portion of an upper surface of resilient sheet member 110. The tack adhesive layer 120 may include any tack adhesive suitable for temporarily attaching the resilient sheet member 110 to the sole of the foot 200. For example, adhesives used in BAND-AIDS™, POST-IT NOTES™, feminine pads, and the like may be used as the tack adhesive layer 120.

Preferably, the tack adhesive used in the tack adhesive layer 120 is sticky enough to reliably hold the foot protector 100 against the foot 200, but is not so sticky that it causes difficulty or discomfort in removing the foot protector 100 from the sole of the foot 200. The easier it is to remove the foot protector 100 from the sole of the foot 200, the more the wearer can experience the comfort level of a conventional slipper.

Those skilled in the art, once given this disclosure, will be able to select a suitable tack adhesive for the tack adhesive layer 120 based on the materials and size selected for the foot protector.

The foot protector 100 preferably has a thickness in the range of about 1 mm to about 5 mm, with a thickness of about 2 mm, for example, being particularly advantageous. This foot protector thickness has many advantages. First, a thickness of about 1 mm to about 5 results in a foot protector 100 that has enough resilience, or cushion effect, to provide comfort to the foot of the wearer, but which is lightweight enough that it can be held to the foot 200 with an adhesive having relatively low tack, or stickiness. Second, a foot protector 100 that has a thickness of about 1 mm to 5 mm has relatively little bulk or weight, and thus may be easily carried in a purse, handbag, fanny pack or backpack, for example, or provided in a dispenser. Third, this lightweight foot protector also provides the wearer with added comfort as the protector does not add too much bulk or weight to the wearer's foot. Fourth, since only a small amount of material is required to make a foot protector 100 with a thickness of 1 mm to 5 mm, the foot protector can be inexpensively manufactured from a materials cost standpoint.

The foot protector in FIG. 2 is shown on a wearer's foot having a high arch. As illustrated, the inventive foot protector, due to its relatively small thickness and flexibility, is able to closely conform to the three-dimensional contours of the sole of the foot. This is particularly the case when a fibrous layer is used as the resilient sheet member. Thus, an additional benefit is provided by the relatively small thickness, and through appropriate material selection, that allows the foot protector to be flexible enough to conform to the specific curvature of a bottom of the wearer's foot, as shown. This provides better tack properties as a greater contact surface area, and in particular a greater contiguous contact surface area, can be provided. It also allows for conformance with a variety of feet shapes and contours, such as high arches or flat arches. Further, this allows increased mobility as the foot protector 100 is able to adjust to flexing of the foot during normal walking or running movements without inhibiting foot movement or causing the tack adhesive to tear away from the foot.

Additionally benefit can be achieved by making the resilient sheet member 110 of substantially uniform thickness. This allows for greatly reduced manufacturing cost and time as many resilient sheet members 110 can easily be stamped from a large, substantially constant thickness sheet of resilient material. Moreover, directionality is not a concern so the foot protector can be patterned on the large sheet in any orientation.

Figure 3:
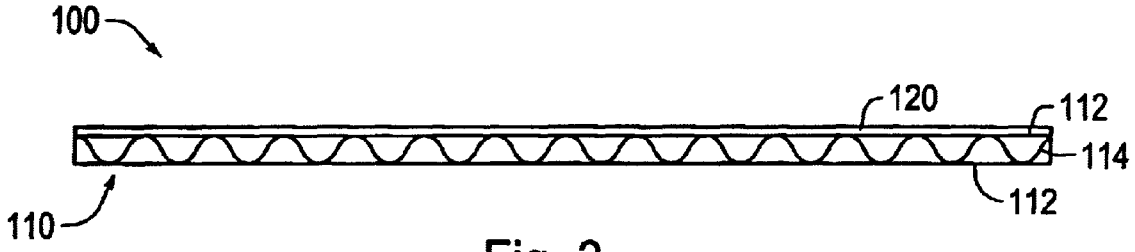
FIG. 3 shows a cross-sectional view of a first exemplary structure of the foot protector of FIG. 1 taken along line 3—3.

Various materials and/or structures may be used to form the resilient sheet member 110. For example, as shown in FIG. 3, which shows a cross section of the foot protector 100 along line 3—3, the resilient sheet member 110 may be formed by a corrugated sheet member 114 interposed between two flat sheet members 112. This structure may correspond to cardboard, for example, which is a quite inexpensive and a readily available material. Other lightweight, corrugated materials, such as lightweight corrugated plastics could be substituted and would have added benefits of water resistance.

Figure 4:
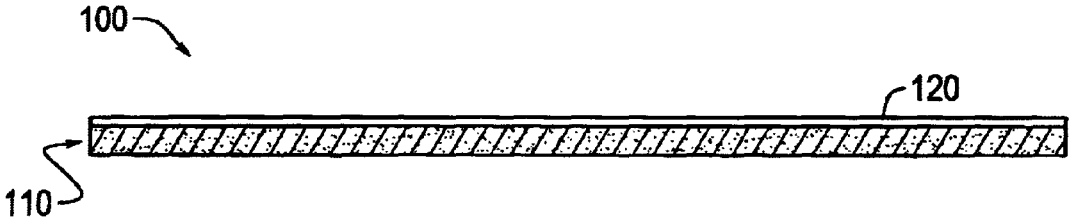
FIG. 4 shows a cross-sectional view of a second exemplary structure of the foot protector of FIG. 1 also taken along line 3—3.

FIG. 4 shows a structure of the resilient sheet member 110 that is formed by a fibrous layer or foam rubber layer. When the sheet member 110 is a fibrous layer, fibers of the layer may be synthetic fibers, such as polypropylene fibers, or natural fibers, such as paper or cloth fibers. Preferably, the fibers are randomly oriented to provide a good degree of resilience and flexibility. An exemplary material is a spunbond polypropylene, such as that described in U.S. Pat. No. 4,801,494 to Datta et al.

Advantages of a fibrous structure or a foam rubber structure, as opposed to harder rubbers, plastics or cardboard, include easy conformance of the foot protector to the contour of the sole of a foot. Thus, unlike a normal shoe sole, which is relatively stiff, the foot protector of this invention is relatively soft and flexible and easily conforms to the contour of the sole of the foot. This allows the foot protector 100 to feel more like a soft house slipper than a shoe or sandal. As mentioned earlier, this also provides an increased contact patch area in which the tack adhesive can effectively bond to the wearer's foot and allows greater mobility of the foot without losing adhesion. Thus, the inventive foot protector is less likely to fall off and has a maximized effectiveness for a given tack adhesive as a larger contact surface can reliably be used.

Figure 5:
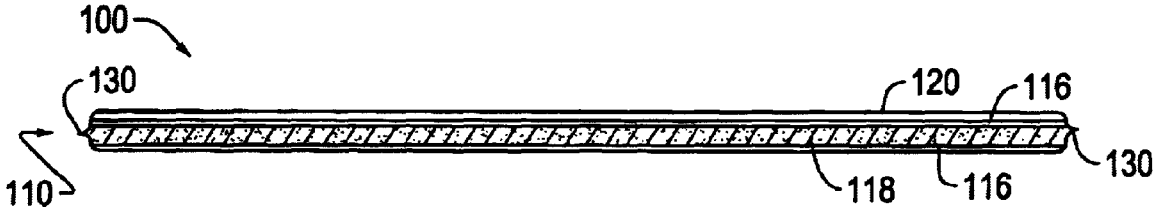
FIG. 5 shows a cross-sectional view of a third exemplary structure of the foot protector of FIG. 1 also taken along line 3—3.

FIG. 5 shows another exemplary embodiment of the foot protector 100. This embodiment includes a multi-layered resilient sheet member 110 formed by a foam rubber layer or fibrous layer 118 sandwiched between external layers 116. The layers 116 may be any desired synthetic or natural material, and preferably have a better wear resistance than the foam rubber layer or fibrous layer 118. Edge portions 130 are joined together by heat crimping, gluing, stitching or the like to hold the layers 116 and 118 together. It should be appreciated that a single external layer 116 may be provided on one side or the other of the layer 118, rather than having two layers 116 sandwiching layer 118.

Figure 6:
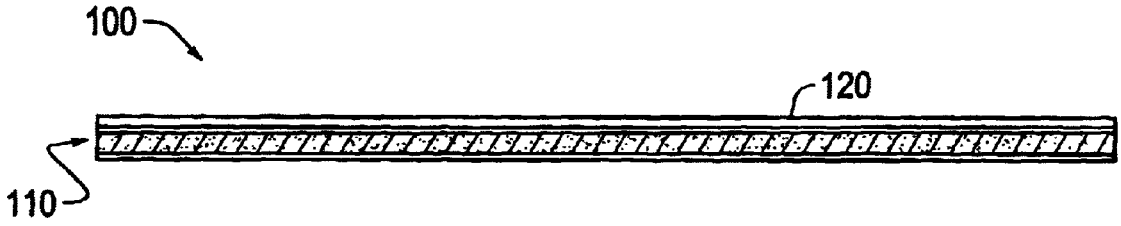
FIG. 6 shows a cross-sectional view of a fourth exemplary structure of the foot protector of FIG. 1 also taken along line 3—3.
Figure 7:
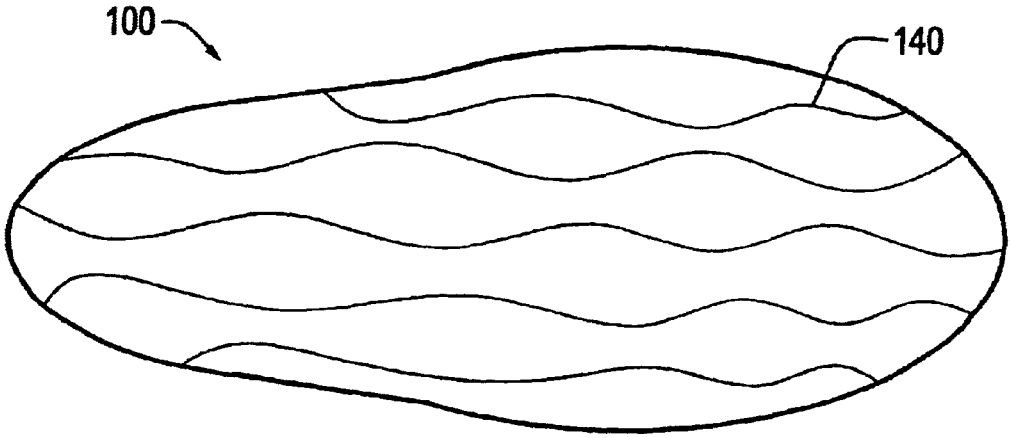
FIG. 7 shows a bottom view of the foot protector structure of FIG. 6.

FIGS. 6 and 7 show another exemplary embodiment of the foot protector 100. In this embodiment, rather than having edge portions joined together, quilted portions 140 are provided to hold the layers 116 and 118 together. Quilted portions 140 can be achieved by stitching, heat bonding, gluing, crimping or the like of the fibrous or foam rubber layers 116 and 118. Preferably, the quilting 140 is provided at various spacings across the outer surface area of layers 116.

Figure 8:
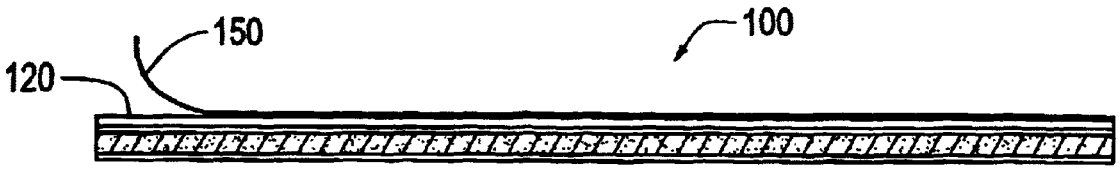
FIG. 8 shows a cross-sectional view of a fifth exemplary structure of the foot protector of FIG. 1 along line 3—3.

FIG. 8 shows another exemplary embodiment of the foot protector 100. In this embodiment, a peel-off layer 150 is provided to protect the tack adhesive layer 120 until the foot protector is to be applied to a wearer's foot. It should be appreciated that a peel-off layer may be provided on any of the embodiments of this invention.

The foot protector of the invention can be provided in kit form and may comprise two or more foot protectors in a package. However, due to the inexpensive nature and disposability of the foot protector, it may come in a larger package or dispenser with many pairs of foot protectors. Also, while the package may come in a variety of specific sizes, it can also be provided in a reduced number of sizes, with the ability to be "cut to fit" by the wearer prior to use.

While this invention has been described in conjunction with the exemplary embodiments described above, many equivalent alternatives, modifications and variations will become apparent to those skilled in the art once given this disclosure. Accordingly, the exemplary embodiments of the invention as set forth above are considered to be illustrative and not limiting. Various changes to the described embodiments may be made without departing from the spirit and scope of the invention.

For example, while a foot protector 100 is shown attached directly to a foot 200, the foot protector may also be attached to a stocking or sock worn on the foot, with the tack adhesive releasably bonding to the stocking or sock of a wearer's foot.

What is claimed is:

1. A foot protector, comprising:

a cushion member of substantially uniform thickness having a shape generally matching a shape of a sole of a wearer's foot and having a size at least as large as a size of the foot, the cushion member having a foot-contact surface and not having a thickened heel portion; and a tack adhesive layer provided on at least a portion of the foot-contact surface, wherein the thickness of the cushion member is about 2 mm.

2. A foot protector comprising:

a cushion member of substantially uniform thickness having a shape generally matching a shape of a sole of a wearer's foot and having a size at least as large as a size of the foot, the cushion member having a foot-contact surface and not having a thickened heel portion; and a tack adhesive layer provided on at least a portion of the foot-contact surface, wherein the cushion member is formed from a plurality of layers including a layer of randomly oriented fibers.

3. A foot protector, comprising:

a cushion member that easily conforms to a bottom surface of a wearer's foot, the cushion member having a shape generally matching a shape of a sole of the wearer's foot and having a size at least as large as a size of the foot, the cushion member having a foot-contact surface; and a tack adhesive layer provided on at least a portion of the foot-contact surface.

4. The foot protector as set forth in claim 3, wherein a thickness of the cushion member is in a range of about 1 mm to about 5 mm.

5. The foot protector as set forth in claim 3, wherein a thickness of the cushion member is about 2 mm.

6. The foot protector as set forth in claim 3, wherein the cushion member is formed from a plurality of layers.

7. The foot protector as set forth in claim 6, wherein the plurality of layers includes a layer of randomly oriented fibers.

8. The foot protector as set forth in claim 6, wherein the plurality of layers includes a corrugated layer.

9. The foot protector as set forth in claim 6, wherein the plurality of layers are quilted together at quilting portions, the quilting portions occupying an area much smaller than a total area of the foot protector.

10. The foot protector as set forth in claim 3, further comprising a peel-off layer detachably provided on the tack adhesive layer.

11. A method of protecting a sole of a foot, comprising:

providing a cushion member of substantially uniform thickness having a shape generally matching a shape of a sole of the foot and having a size at least as large as a size of the foot, the cushion member having a foot-contact surface and not having a thickened heel portion;

providing a tack adhesive layer on at least a portion of the foot-contact surface; and applying the cushion member to the sole of the foot such that the tack adhesive layer contacts the sole of the foot, wherein the step of applying also conforms the cushion member to the specific curvature of the sole of the foot.

12. A kit comprising a saleable package including at least two of the foot protectors of claim 3.

13. A foot protector, comprising:

a resilient sheet member of substantially uniform thickness of about 2 mm, having a shape generally matching a shape of a sole of a wearer's foot and having a size at least as large as a size of the foot, the resilient sheet member having a foot-contact surface; and a tack adhesive layer provided on at least a portion of the foot-contact surface.

* * * * *